US005105794A

United States Patent [19]

Fukuda

[11] Patent Number: 5,105,794

[45] Date of Patent: Apr. 21, 1992

[54] IGNITION SYSTEM FOR INTERNAL COMBUSTION ENGINE

[75] Inventor: Kenji Fukuda, Susono, Japan

[73] Assignee: Kokusan Denki Co., Ltd., Numazu, Japan

[21] Appl. No.: 648,591

[22] Filed: Jan. 31, 1991

[30] Foreign Application Priority Data

Jan. 31, 1990 [JP] Japan ..... 2-8819[U]

[51] Int. Cl.[5] ..... F02P 1/00

[52] U.S. Cl. ..... 123/651; 123/149 C

[58] Field of Search ..... 123/599, 601, 651, 149 R, 123/149 A, 149 D, 149 C

[56] References Cited

U.S. PATENT DOCUMENTS

| | | | |
|---|---|---|---|
| 3,722,488 | 3/1973 | Swift et al. | 123/149 R |
| 4,163,437 | 8/1979 | Notaras et al. | 123/149 A |
| 4,173,963 | 11/1979 | Heuweiser et al. | 123/149 D |
| 4,175,509 | 11/1979 | Orova et al. | 123/149 C |
| 4,566,425 | 1/1986 | Nitou et al. | 123/600 |
| 4,727,851 | 3/1988 | Orova | 123/599 |

*Primary Examiner*—Tony M. Argenbright
*Attorney, Agent, or Firm*—Pearne, Gordon, McCoy & Granger

[57] ABSTRACT

An ignition system of the current interruption type for internal combustion engine wherein a three-pole magneto having a magnet positioned in a recess formed at a magnetic rotor is used as a power supply for the ignition system and a transistor switch circuit is used for interrupting a primary current of an ignition coil device is disclosed which is capable of significantly increasing an advance angle width. Pole arc angles $\alpha$ of a pair of stator magnetic poles are set to be equal to each other and an angular interval $\alpha$ between stator magnetic poles is set to be equal to or less than an angular interval $\beta$ between rotor magnetic poles adjacent to each other. Also, an angular interval $\delta$ between the outer ends of the stator magnetic poles is set to be larger than an angular interval $\epsilon$ between the first rotor magnetic pole and the third rotor magnetic pole. Such construction permits a magnetic flux flowing in a core of the ignition coil device to be strained to increase the advance angle width.

4 Claims, 2 Drawing Sheets

IGNITION SYSTEM FOR INTERNAL COMBUSTION ENGINE

BACKGROUND OF THE INVENTION

This invention relates to an ignition system for an internal combustion engine, and more particularly to an ignition system of the current interruption type using a magneto as a power supply.

For an internal combustion engine is widely used an ignition system of the current interruption type which is adapted to interrupt a primary current flowing through an ignition coil device arranged in a magneto driven by the internal combustion engine to generate a high voltage for ignition. Such an ignition system of the current interruption type is disclosed in, for example, U.S. Pat. No. 4,163,437, U.S. Pat. No. 4,175,509 and U.S. Pat. No. 4,173,963.

A magneto used in such an ignition system generally includes a three-pole magnetic rotor including a first rotor magnetic pole comprising a magnetic pole defined on the side of the outer periphery of a magnet centrally positioned in a recess provided on the outer periphery of a rotor body made of a magnetic material, and a second rotor magnetic pole and a third rotor magnetic pole respectively comprising magnetic poles defined on the peripheral portions of the rotor body defined by dividing the outer periphery of the rotor body into two sections through the recess. Also, the magneto includes an ignition coil device including a coil wound on a stator core provided at both ends thereof with a pair of stator magnetic poles which are defined so as to be opposite to the magnetic poles of the magnetic rotor. An example of the three-pole magnetic rotor constructed as described above is disclosed in U.S. Pat. No. 4,566,425.

The ignition coil device is provided on the primary side thereof with a transistor switch circuit connected in parallel to a primary coil of the ignition coil device and an interruption control circuit for detecting a voltage across the transistor switch circuit or primary coil and interrupting the transistor switch circuit when the detected voltage reaches a predetermined level. The output of the ignition coil device on the side of its secondary coil is applied to an ignition plug mounted on a cylinder of the engine.

The magnetic rotor is generally mounted on an output shaft of the engine. Rotation of the engine causes an AC voltage to be induced across the primary coil of the ignition coil device. When a half wave voltage of one polarity is induced across the primary coil, the transistor switch circuit is supplied with a base current, resulting in being turned on, leading to flowing of a primary current from the primary coil through the transistor switch circuit. When the primary current reaches a predetermined magnitude, the voltage across the transistor switch circuit or primary coil reaches a predetermined level, so that an interruption control circuit renders the transistor switch circuit turned off or non-conductive to interrupt the primary current, leading to induction of a relatively high voltage across the primary coil. The ignition coil device increases the voltage thus induced to cause a high voltage for ignition to be induced across the secondary coil of the ignition coil device. The high voltage results in spark occurring at the ignition plug, leading to ignition of the engine.

In the conventional ignition system constructed as described above, an increase in engine speed increases the voltage induced across the primary coil of the ignition coil device, so that the voltage across each of the primary coil and transistor switch circuit is increased. This causes an ignition position at which the voltage across the transistor switch circuit or primary coil reaches a predetermined level to be advanced, leading to advance of the ignition position.

In the conventional ignition system of the current interruption type described above, an angular interval from starting of rising-up of the primary current to ascending of the current to a peak value is a theoretical maximum advance angle width. However, an actual advance angle width is considerably small as compared with the maximum advance angle width. An increase in advance angle width requires to increase the angular interval from starting of rising-up of the primary current to ascending of the current to a peak value. Unfortunately, the conventional ignition system using the three-pole magneto fails to increase the angular interval, resulting in failing to increase the advance angle width.

A failure in increase of the advance angle width possibly causes the ignition operation carried out when the engine is started or when the engine is driven at a low speed to be unstable, because an ignition position at which the engine driven at a low speed is ignited is considerably advanced where an ignition position at which an ignition of the engine driven at a high speed is carried out is set at a position advanced by a predetermined angle from the top dead center of the engine. In particular, when the engine is started by means of a hand or foot starter, the starter is pushed back when the engine is driven at a low speed, resulting in a driver being possibly damaged.

SUMMARY OF THE INVENTION

The present invention has been made in view of the foregoing disadvantage of the prior art.

Accordingly, it is an object of the present invention to provide an ignition system for an internal combustion engine which is capable of significantly increasing the advance angle width irrespective of using a three-polarity magneto.

It is another object of the present invention to provide an ignition system for an internal combustion engine which is capable of facilitating the manufacturing and/or assembling.

It is a further object of the present invention to provide an ignition system for an internal combustion engine which is capable of reducing the manufacturing cost.

In accordance with the present invention, an ignition system for an internal combustion engine is provided which comprises a magnetic rotor including a rotor body made of a magnetic material and provided on the outer periphery thereof with a recess and a magnet centrally positioned in the recess; the magnetic rotor having three magnetic poles comprising a first magnetic pole defined on the outer periphery of the magnet and second and third magnetic poles defined on the outer peripheral portions of the rotor body with the recess being interposed therebetween; a magneto including an ignition coil device which includes a stator core having a pair of stator magnetic poles opposite to the three magnetic poles of the magnetic rotor defined at both ends thereof and a coil wound on the core; the stator magnetic poles of the stator core having the same pole arc angle $\gamma$; the stator magnetic poles being arranged so that an angular interval $\alpha$ therebetween is set to be equal to or below angular intervals $\beta$ between the first rotor magnetic pole and the second rotor magnetic pole and between the first rotor magnetic pole and the third rotor magnetic pole; the stator magnetic poles being arranged so that an angular interval $\delta$ between the outer ends of the stator magnetic poles is set to be larger than an angular interval $\epsilon$ between the second rotor magnetic pole and the third rotor magnetic pole; a transistor switch circuit connected to in parallel to a primary coil of the ignition coil device; and an interruption control circuit for interrupting the transistor switch circuit when a voltage across the transistor switch circuit or the primary coil reaches a predetermined level.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, an ignition system for an internal combustion engine according to the present invention will be described hereinafter with reference to the accompanying drawings.

Figure 1:
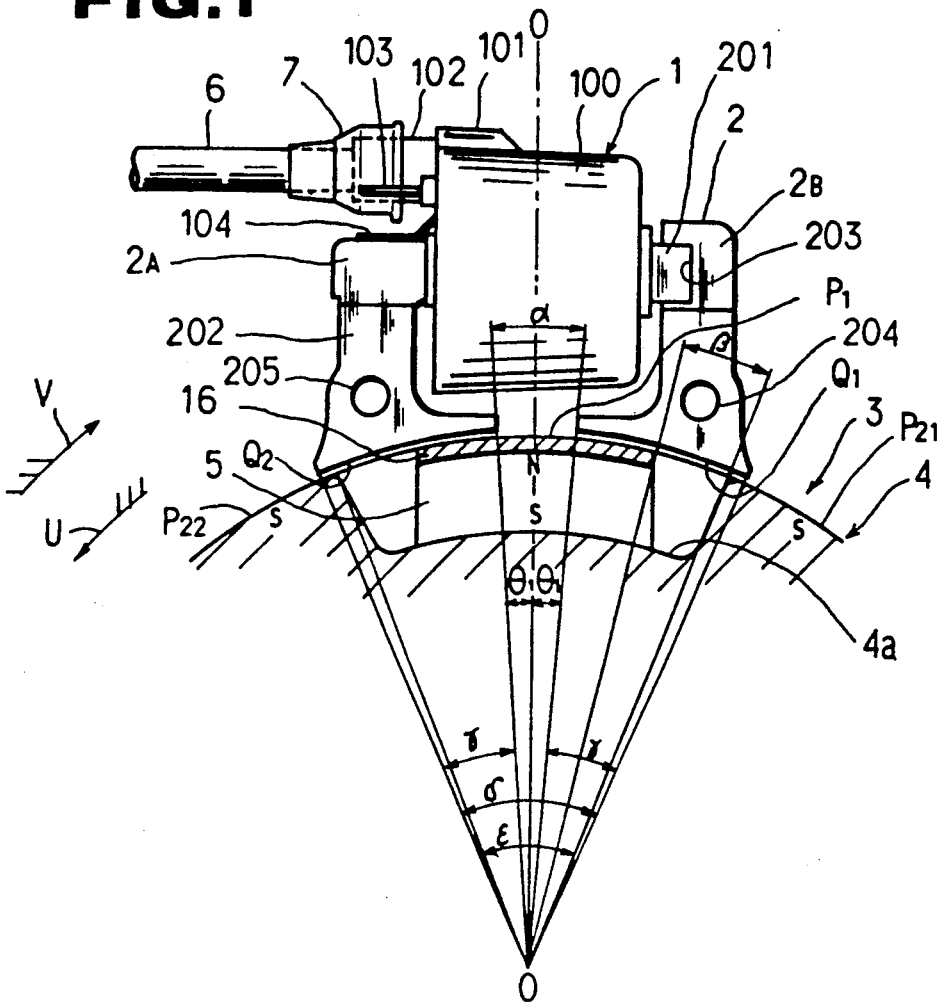
FIG. 1 is a front elevation view partly in section showing an essential part of a magneto used in an embodiment of the present invention.

FIG. 1 shows a magneto suitable for use in an embodiment of the present invention, wherein reference numeral 1 designates an ignition coil wound on stator core 2, and 3 is a magnetic rotor constructed by centrally positioning a single magnet 5 in a recess 4a formed on the outer periphery of a disc-like rotor body 4 made of iron.

Against a magnetic pole face on the side of the outer periphery of the magnet 5 of the magnetic rotor 3 is abutted a pole piece 16. The pole piece 16 and magnet 5 are fixed on the bottom of the recess 4a by means of a screw threadedly inserted therethrough. The magnet 5 is magnetized in the radial direction of the rotor so that an N pole appears on the side of the outer periphery thereof. An S pole appears on the outer peripheral portions of a rotor body of the rotor with the recess 4a being interposed therebetween. The magnetic pole on the side of the outer periphery of the magnet 5 constitutes a first rotor magnetic pole Pl and the outer peripheral portions of the rotor body on both sides of the recess 4a constitute second and third rotor magnetic poles P21 and P22. The magnetic rotor 3 is mounted on an output shaft of an internal combustion engine (not shown) so as to be rotated in a U or V direction in synchronism with the engine.

The stator core 2 on which the ignition coil is wound comprises a first core forming element 2A of a substantially L-shape including a coil wound section 201 of an I-shape and a leg section 202 perpendicularly extending from one end of the coil wound section 201 which are formed integral with each other, and a second core forming element 2B provided at one end thereof with a recess 203 of a U-shape in which the other end of the coil wound section 201 of the first core forming element 2A is fitted to join the second core forming element 2B to the first core forming element 2A in a manner to be perpendicular to the first core forming element 2A. The core forming elements 2A and 2B each may comprise a laminate formed of a steel plate material. The second core forming element 2B and the leg section 202 of the first core forming element 2A are provided at the distal end thereof with stator magnetic poles Q1 and Q2 in a manner to form a pair and be opposite to the rotor magnetic poles, respectively.

The ignition coil 1 comprises a primary coil wound on a primary bobbin and a secondary coil coaxially wound on the outer periphery of the primary coil through a secondary bobbin which are wrapped by a resin mold 100. Such construction of the ignition coil 1 is known in the art. The resin mold 100 is formed with an expansion 101, in which a secondary terminal leading-out cylinder 102 provided therein with a secondary terminal connected to an isolated or nongrounded terminal of the secondary coil is embedded at one end thereof in the expansion 101. In the secondary terminal leading-out cylinder 102 is inserted one end of a high-tension cable 6, so that a core of the high-tension cable is connected to the secondary terminal in the leading-out cylinder 102. A rubber bushing 7 is fittedly arranged so as to extend between the portion of the high-tension cable 6 in proximity to its base and the secondary terminal leading-out cylinder 102, to thereby ensure waterproofness of a connection between the high-tension cable 6 and the secondary terminal. Through the end surface of the mold 100 on the side of the secondary terminal leading-out cylinder 102 are led out a primary terminal 103 and an earthing terminal 104 connected to the isolated terminals of the primary and secondary windings.

The ignition coil 1 is wound on the coil wound section 201 of the first core forming element 2A and then the second core forming element 2B is mounted on the end of the coil wound section 201 of the first core forming element 2A, resulting in a stator of the magneto being assembled. The earthing terminal 104 of the ignition coil 1 is abutted against the end of the leg section 202 of the stator core 2, to thereby be electrically connected thereto.

In the magneto constructed as described above, pole arc angles $\alpha$ of the stator magnetic poles Q1 and Q2 are set to be equal to each other, and an angular interval $\delta$ between the outer ends of the stator magnetic poles Q1 and Q2 is set to be larger than an angular interval $\epsilon$ between the second rotor magnetic pole P21 and the third rotor magnetic poles P22.

Also, the magneto is so constructed that the vicinity of each of the inner ends of the stator magnetic poles Q1 and Q2 overlaps the first rotor magnetic pole Pl (magnetic piece 16) while coinciding a straight line 0—0 (a center line of the ignition coil) by which the primary and secondary coils of the ignition coil 1 are equally divided into two with the center of the magnet 5. In the conventional magneto described above, the amount of overlapping between the magnetic piece 16 and each of the stator magnetic poles Q1 and Q2 is set to be about 2 mm, resulting in $\alpha > \beta$. On the contrary, in the present invention, the inner ends of the stator magnetic poles Q1 and Q2 are extended to a position which causes an angle $\theta 1$ defined between the center line 0—0 of the ignition coil 1 and the inner ends of the stator magnetic poles Q1 and Q2 to be one half as large as each of angular intervals $\beta$ between the first rotor magnetic pole Pl and the second rotor magnetic pole P21 and between the first rotor magnetic pole Pl and the third rotor magnetic pole P22 or less. Such construction permits an angular interval $\alpha$ between the stator magnetic poles Q1 and Q2 to be equal to or less than the angular interval $\beta$ between the rotor magnetic poles, leading to an increase in the amount of overlapping between the stator magnetic poles and the magnetic piece 16.

The stator core 2 is fixed on a stator mount provided on a casing of the engine or the like by means of bolts (not shown) inserted through mounting holes 204 and 205 respectively provided at the leg section 202 of the first core forming element 2A and the second core forming element 2B. The stator magnetic poles Q1 and Q2 are arranged opposite to the rotor magnetic poles through a gap of a predetermined distance defined therebetween.

Figure 2:
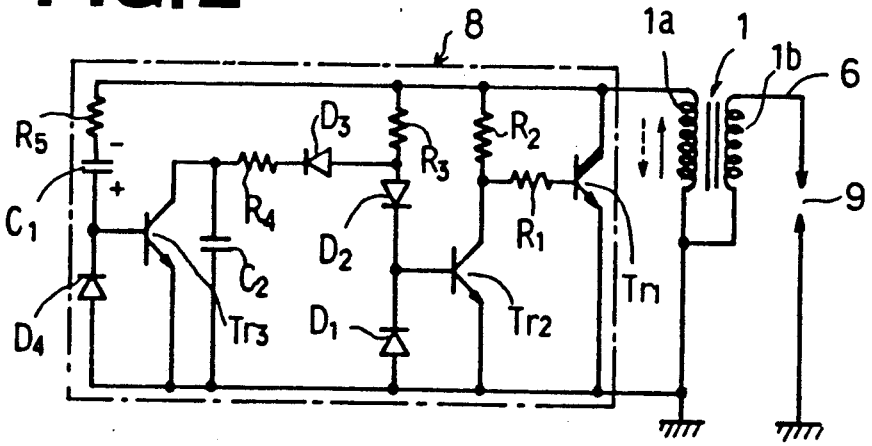
FIG. 2 is a circuit diagram showing a circuit of an ignition circuit used in an embodiment of an ignition system according to the present invention.

FIG. 2 shows an ignition system of the current interruption type for an internal combustion engine wherein the magneto described above is used as a power supply. The ignition coil 1 includes the primary coil 1*a* and the secondary coil 1*b* each grounded at one end thereof. To the primary coil 1*a* is connected a primary current control circuit 8 and to the secondary coil 1*b* is connected an ignition plug 9 mounted on the cylinder of the engine through the high-tension cable 6.

The primary current control circuit 8 includes a transistor switch circuit comprising a composite transistor Tr1 of which the collector-emitter circuit is connected in parallel to the primary coil 1*a*. The composite transistor Tr1 comprises a plurality of transistors connected together in the form of Darlington connection. The transistor Tr1 is supplied with a base current from the side of the other end (nongrounded terminal) of the primary coil 1*a* through resistors R1 and R2.

The base-emitter circuit of the transistor Tr1 is connected thereto of the collector-emitter circuit of an NPN transistor Tr2, and the base of the transistor Tr2 is connected to a common connection between the cathodes of diodes D1 and D2. The anode of the diode D1 is grounded and the anode of the diode D2 is connected through a resistor R3 to the other end of the primary coil 1*a*. To the anode of the diode D2 is connected the anode of a diode D3, of which the cathode is connected through a resistor R4 to the collector of a transistor Tr3. The emitter of the transistor Tr3 is grounded and its base is connected to the cathode of a diode D4 of which the anode is grounded. Also, to the base of the transistor Tr3 is connected one end of a capacitor C1, of which the other end is connected to the other end of the primary coil 1*a* through a resistor R5. The collector-emitter circuit of the transistor Tr3 is connected across a capacitor C2. In the illustrated embodiment, the transistor Tr2 and Tr3, the diodes D1 to D4, the resistors R3 and R4, and the capacitor C1 constitute an interruption control circuit for interrupting the transistor switch circuit comprising the transistor Tr1 when a voltage across the transistor switch or the primary coil 1*a* reaches a predetermined level.

In the ignition system described above, rotation of the engine causes an AC voltage to be induced across the primary coil 1*a* of the ignition coil 1. When a half wave voltage of a polarity indicated at an arrow of dotted lines is induced across the primary coil 1*a*, the capacitor C1 is charged at polarities shown in FIG. 2 from the primary coil 1*a* through the diode D4. The transistor Tr3 is supplied with a base current through the resistor 5 and capacitor C1 immediately when a half wave voltage of a polarity indicated at an arrow of a solid line is induced across the primary coil 1*a*, so that the transistor Tr3 is turned on. The turning-on of the transistor Tr3 causes the voltage across the primary coil 1*a* to be divided by the resistors R3 and R4, and the divided voltage is applied to the baseemitter circuit of the transistor Tr2. However, at the initial stage, the voltage fails to reach a level at which the transistor Tr2 is triggered, resulting in the transistor being kept interrupted. Thus, the transistor Tr1 is supplied with a base current from the primary coil 1*a* through the resistors R2 and R1, to thereby be turned on. The turning-on of the transistor Tr1 causes a primary current of a large magnitude to be flowed from the primary coil 1*a* through the collector-emitter circuit of the transistor Tr1. When the primary current reaches a peak value and a voltage across the collector-emitter circuit of the transistor Tr1 reaches a peak value, charging of the capacitor C1 is completed to interrupt the transistor Tr3. This causes the voltage across the collector-emitter circuit of the transistor Tr1 to charge the capacitor C2 through the resistor R3, diode D3 and resistor R4. The transistor Tr2 is not substantially supplied with a base current while the voltage across the capacitor C2 is low, so that the transistor Tr2 is kept interrupted. When the voltage across the capacitor C2 is increased to a predetermined level, the transistor Tr2 is supplied with a base current of a predetermined magnitude or more, to thereby be turned on, leading to interruption of the transistor Tr1. This causes the primary current to be interrupted, so that a high voltage may be induced across the primary coil 1*a*. The so-induced voltage is increased by the ignition coil, thus, a high voltage for ignition is produced across the secondary coil 1*b*. The voltage is then applied to the ignition plug 9 to generate spark at the ignition plug, resulting in the engine being ignited.

Thus, when the engine speed is within a low range, ignition of the engine is carried out at a position at which the capacitor C2 is charged to a predetermined voltage after the voltage across the collector-emitter circuit of the transistor Tr1 or the voltage across the primary coil 1*a* exceeds the peak value.

When the engine speed is increased to increase the voltage induced across the primary coil 1*a*, the capacitor C1 is charged. The voltage across the resistor R4 is increased to a predetermined level or more while the transistor is kept turned on, so that the transistor Tr2 is supplied with a base current of a predetermined magnitude or more, resulting in an ignition position or a position at which the transistor Tr2 is turned on being advanced. Thus, the ignition position is advanced with an increase in engine speed.

An experiment for measuring an advance angle width took place by varying an angular interval $\alpha$ between the stator magnetic poles Q1 and Q2 to observe a waveform of a primary current. The experiment revealed that when the inner ends of the stator magnetic poles Q1 and Q2 are extended to increase in the amount of overlapping between each of the stator magnetic poles and the rotor magnetic pole Pl, an angular interval from starting of rising-up of the primary current to ascending of the current to a peak value may be increased to increase the advance angle width.

Figure 3:
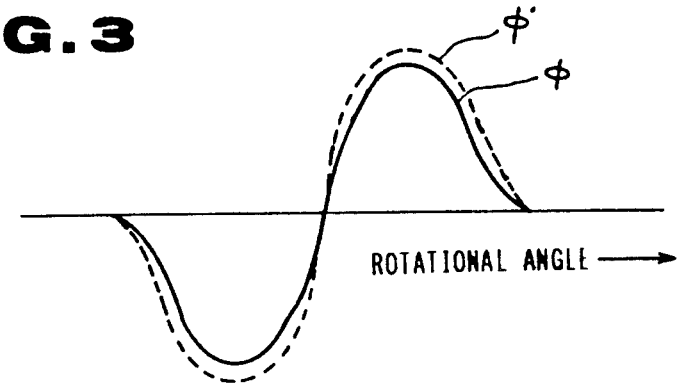
FIG. 3 is a waveform chart showing relationships of waveforms of magnetic fluxs of a magneto used in an ignition system of the present invention and a conventional magneto to an rotational angle.

FIG. 3 shows a waveform of a magnetic flux occurring at the ignition coil of each of the magneto used in the illustrated embodiment and the conventional magneto, wherein $\phi'$ indicated at broken lines represents a waveform of a magnetic flux in the conventional magneto in which the amount of overlapping is set to be about 2 mm and $\phi$ indicated at a solid line represents a waveform of a magnetic flux obtained when the angular interval $\alpha$ of the stator magnetic poles is set to be equal to the angular interval $\beta$ of the rotor magnetic poles. As can be seen from FIG. 3, the magneto used in the present invention causes the waveform of the magnetic flux to be delayed in rising-up, to thereby be strained or distorted. Such distortion of the waveform permits the angular interval from starting of rising-up of the primary current to ascending of the current to a peak value to be increased, so that the advance angle width may be increased.

Figure 4:
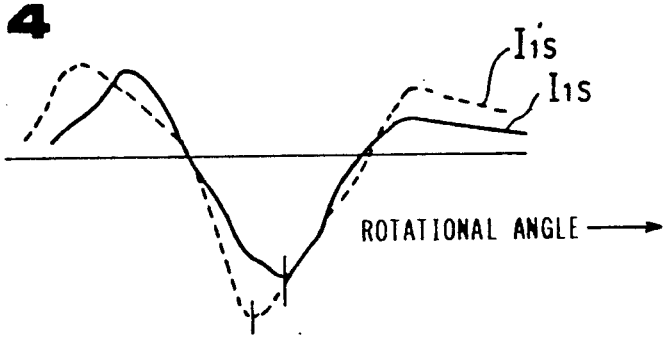
FIG. 4 is a waveform chart showing a waveform of a primary short circuit current flowing when a primary coil is short-circuited while a primary current control circuit is not connected to an ignition coil device of each of a magneto used in the present invention and a magneto used in a conventional ignition system.

FIG. 4 shows a waveform of a primary short circuit current obtained when only the magneto is rotated at a low speed without connecting the ignition circuit thereto, wherein broken lines indicate a waveform of a primary short circuit current I1s' of the conventional magneto and a solid line indicates a waveform of a primary short circuit current I1s of the magneto used in the present invention. FIG. 4 reveals that the magneto used in the present invention causes the waveform of the primary current to be delayed in rising-up, resulting in ascending of the primary current to a peak value being substantially delayed.

Figure 5:
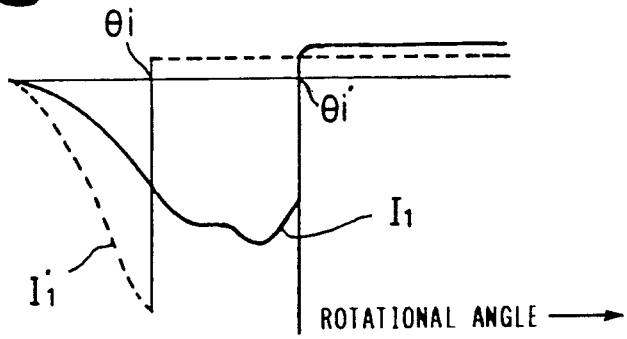
FIG. 5 is a waveform chart showing a waveform of a primary current of each of an ignition system of the present invention and a conventional ignition system.

FIG. 5 shows a waveform of a primary current flowing through the primary coil at a low engine speed when the primary coil 1a of the ignition coil 1 is connected thereto the primary current control circuit shown in FIG. 2, wherein broken lines indicate a waveform of a primary current I1' obtained when the conventional magneto is used and a solid line indicates a waveform of a primary current I1 obtained in the illustrated embodiment. In FIG. 5, $\theta i'$ and $\theta i$ indicate an ignition position of the conventional ignition system and an ignition system of the present invention each driven at a low engine speed, respectively. The primary currents I1' and I1 are interrupted at the ignition positions, respectively, so that the ignition operation is carried out. Thus, it will be noted that the present invention substantially delays the ignition position at a low engine speed, to thereby prevent the ignition position from being advanced at a low engine speed, so that the starting of the engine and the operation of the engine at a low engine speed may be stabilized.

Figure 6:
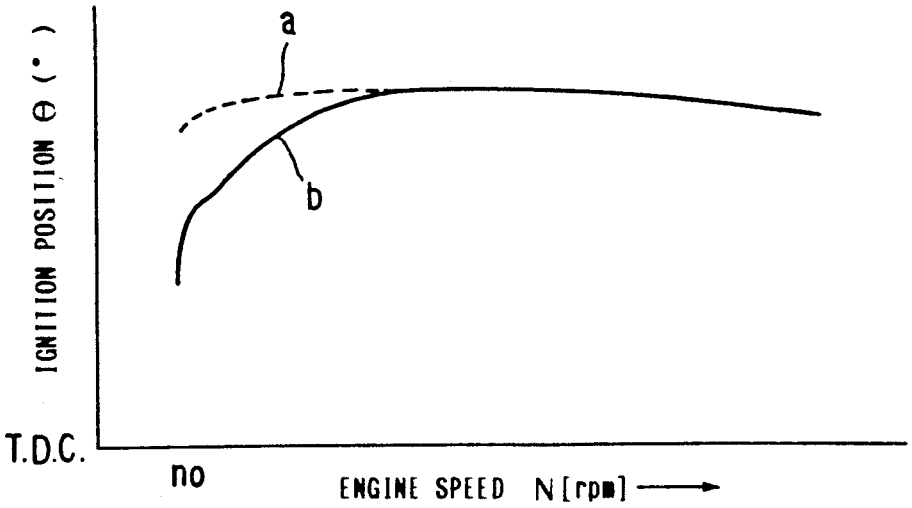
FIG. 6 is a graphical representation showing ignition characteristics of each of an ignition system of the present invention and a conventional ignition system.

FIG. 6 shows ignition characteristics a of the conventional ignition system and ignition characteristics b of the ignition system of the present invention. The words "ignition characteristics" are referred to the characteristics of the ignition position $\theta$ to the engine speed N. TDC indicates the top dead center of the engine and the ignition positions are measured while it is moved from the top dead center to the bottom dead center.

In the present invention, it is required that the angular interval $\alpha$ between the stator magnetic poles Q1 and Q2 is set to be equal to or less than the angular interval $\beta$ between the rotor magnetic poles, however, an excessive decrease in $\alpha$ causes a voltage induced across the primary winding to be reduced. Accordingly, the angular interval $\alpha$ between the stator magnetic poles Q1 and Q2 is set within a range of $\alpha \leqq \beta$ so as to limit a decrease in lowering of output of the magneto within a range which does not adversely affect the ignition operation and permit a predetermined advance angle width.

As can be seen from the foregoing, the ignition system of the present invention is so constructed that the angular interval $\alpha$ between the stator magnetic poles Q1 and Q2 is set to be equal to or below each of the angular intervals $\beta$ between the first rotor magnetic pole and the second rotor magnetic pole and between the first rotor magnetic pole and the third rotor magnetic pole and the angular interval $\delta$ between the outer ends of the stator magnetic poles is set to be larger than the angular interval $\epsilon$ between the second rotor magnetic pole and the third rotor magnetic pole to increase the amount of overlapping between the stator magnetic pole and the rotor magnetic pole. Such construction of the present invention permits the stator magnetic pole to be opposite to both two rotor magnetic poles adjacent to each other to considerably increase an interval through which a part of the magnetic flux is by-passed before the magnetic flux flowing through the stator core from the rotor magnetic poles reaches a peak value, so that the waveform of the magnetic flux flowing through the stator core is deformed to delay the rising-up of the waveform. Thus, the present invention permits the angular interval from the starting of rising-up of the primary current to ascending of the current to a peak value may be increased to increase the advance angle width.

Also, the present invention is constructed in the manner that pole arc angles of the stator magnetic poles in a pair are set to be equal to each other and the angular intervals between the first and second rotor magnetic poles and between the first and third rotor magnetic poles are set to be equal to each other. Such construction of the present invention permits a voltage of the same waveform to be induced across the primary winding irrespective of a direction in which the stator core is mounted. This permits the stator core to be mounted in the same direction irrespective of the direction of rotation of the internal engine, to thereby facilitate mounting of the stator core.

Further, in the present invention, the same stator core can be used irrespective of the direction of rotation of the internal engine, to thereby accomplish standardization of the stator core, so that a cost for manufacturing the core may be significantly reduced.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An ignition system for an internal combustion engine comprising:

a magnetic rotor including a rotor body made of a magnetic material and provided on the outer periphery thereof with a recess and a magnet centrally positioned in said recess;

said magnetic rotor having three magnetic poles comprising a first magnetic pole defined on the outer periphery of said magnet and second and third magnetic poles defined on the outer peripheral portions of said rotor body with said recess being interposed therebetween;

a magneto including an ignition coil device which includes a stator core having a pair of stator magnetic poles opposite to said three magnetic poles of said magnetic rotor defined at both ends thereof and a coil wound on said core;

said stator magnetic poles of said stator core having the same pole arc angle $\gamma$;

said stator magnetic poles being arranged so the an angular interval $\alpha$ therebetween is set to be not greater than angular intervals $\beta$ between said first rotor magnetic pole and said second rotor magnetic pole and between the first rotor magnetic pole and the third rotor magnetic pole;

said stator magnetic poles being arranged so that an angular interval $\delta$ between the outer ends of said stator magnetic poles is set to be larger than an angular interval $\Gamma$ between said second rotor magnetic pole and said third rotor magnetic pole;

a transistor switch circuit connected in parallel to a primary coil of said ignition coil device; and an interruption control circuit for interrupting said transistor switch circuit when a voltage across one of said transistor switch circuit and said primary coil reaches a predetermined level.

2. An ignition system for an internal combustion engine as defined in claim 1, wherein the inner ends of said stator magnetic poles Q1 and Q2 are extended to a position which causes an angle $\theta 1$ between a center line of said ignition coil device through which said ignition coil device is axially divided into two and the inner ends of said stator magnetic poles to be not more than one half as large as each of the angular intervals $\beta$ between said first rotor magnetic pole and said second rotor magnetic pole and between said first rotor magnetic pole and said third rotor magnetic pole.

3. An ignition system for an internal combustion engine as defined in claim 2, wherein said stator magnetic poles are formed into shapes symmetric with respect to each other and arranged symmetrically about the center line of said ignition coil device.

4. An ignition system for an internal combustion engine as defined in claim 1, wherein said recess is radially outward enlarged.

* * * * *